United States Patent [19]

Anderson

[11] Patent Number: 4,550,999

[45] Date of Patent: Nov. 5, 1985

[54] ELECTROPHOTOGRAPHIC COPYING APPARATUS INCLUDING TRANSFER HOLD-DOWN PUMP

[75] Inventor: Carl P. Anderson, Menlo Park, Calif.

[73] Assignee: Ricoh Company Ltd., Tokyo, Japan

[21] Appl. No.: 586,026

[22] Filed: Mar. 5, 1984

[51] Int. Cl.[4] ..... G03G 15/00

[52] U.S. Cl. ..... 355/3 TR; 355/3 R; 355/3 SH; 271/276

[58] Field of Search ..... 355/3 TR, 14 TR, 3 R, 355/72, 73, 75, 76, 94, 3 SH, 14 SH; 74/567, 569; 271/94, 96, 196, 276

[56] References Cited

U.S. PATENT DOCUMENTS

| | | | |
|---|---|---|---|
| 3,854,814 | 12/1974 | Jones | 74/569 X |
| 4,360,262 | 11/1982 | Genthe | 355/3 TR X |
| 4,403,847 | 9/1983 | Chrestensen | 355/3 TR |
| 4,406,173 | 9/1983 | Lagain | 74/567 X |

*Primary Examiner*—A. T. Grimley
*Assistant Examiner*—Carl Romano
*Attorney, Agent, or Firm*—Flehr, Hohbach, Test, Albritton & Herbert

[57] ABSTRACT

An electrophotographic copying apparatus has an electrically charged toner of one polarity which is transformed from an oppositely electrically charged surface of a photoconductive drum to the front side of a blank sheet where the front side of the blank sheet is intended to be a copy. The back side of the blank sheet engages the outer surface of a transfer drum which is positioned adjacent to the photoconductive drum. The transfer of the toner occurs within a nip defined by the photoconductive drum and the transfer drum. A cam rotates in a timed sequence relative to the transfer drum and with a vacuum pump located adjacent to the transfer drum the cam is in communication with the surface of the transfer drum so that a vacuum is created at the back side of the blank sheet resulting in the blank sheet being held to the surface of the transfer drum by ambient air pressure and the vacuum thus overcoming the electrostatic attraction of the blank sheet to the photoconductive drum.

14 Claims, 6 Drawing Figures

ELECTROPHOTOGRAPHIC COPYING APPARATUS INCLUDING TRANSFER HOLD-DOWN PUMP

The present invention relates generally to an electrophotographic copying apparatus in which electrically charged toner of one polarity is transferred from an oppositely charged electrostatic image to the front side of a blank sheet for transforming the sheet into an intended copy as the back side of the sheet engages the outer surface of the transfer roll positioned adjacent the drum. This apparatus relates particularly to specific means for generating a vacuum to attract the blank paper to the drum and overcome the electrostatic attraction of the paper to the photoconductive surface on which the image to be copied resides.

The present invention is especially suitable for use in electrophotographic apparatus such as is presently being used in the industry. This typical apparatus includes a rotatable drum having a photosensitive outer circumferential surface, and means for rotating the drum in a typical fashion so that the outer circumferential surface defines a fixed annular path of movement. The apparatus produces copies from a given master by first forming an electrostatic latent image corresponding to the particular information to be copied upon the photosensitive surface of the drum. Thereafter, the latent image formed is developed by toner particles, specifically electrically charged, heat fusable particles which are applied to the image bearing surface and held to the latent image by electrostatic attraction. The photoconductive surface of the drum together with the rotating surface of a transfer drum define a transfer nip; in this nip, the applied toner particles are transferred from the drum to a sheet of paper and thereafter fused thereon for transforming the sheet into a permanent copy.

In the apparatus just described, the transfer roll is designed to receive the backside of the blank sheet just before it reaches the transfer nip so the the front side of the sheet is held in an engaging confronting relationship with the toner carrying outer surface of the photoconductive drum. This causes the toner on the drum to be pressed against and transferred to the blank paper from the photoconductive drum.

A problem which inherently occurs in apparatus of this type is that as the charged particles are transferred from the oppositely charged surface of the drum to the surface of the paper, an electrostatic attraction develops between the surface of the drum and the paper. Therefore, it is necessary to provie a force which will attract and hold the copy paper against the transfer roll as the paper travels through the transfer nip area of the copier and then is carried on the transfer roll to succeeding stations.

It is an objective of this invention to provide a regulated force to attract and hold the blank paper to the surface of the transfer roll.

Another object of the invention to provide this attractive force by means of air pressure or the like so that no further electrostatic fields are generated, nor are mechanical clamps or the like required which could interfere with the smooth rotation of both drums through the transfer nip.

Another object of the present invention to provide a simplified mechanical means for generating a vacuum to hold the paper against the transfer roll until it is advanced for delivery to either a fuser or a transport device for further processng.

Another object of the invention is to provide a simple, consistently working mechanical vacuum source which can be structured to consistently apply the vacuum either at or very near to the leading edge of the paper which is to be used as the blank transfer sheet.

A recently issued U.S. Pat. No. 4,400,078 discloses the broad concept of use of a vacuum source to hold the leading edge of a paper against the transfer roll. However, the present design provides a significantly stronger vacuum with a more easily maintainable system, the vacuum being developed by a pump external to the transfer roll.

Another object of the present invention is to provide a timed vacuum generator comprising low profile mechanical structure which will not interfere in any way with the design of compact, low profile copy machines such as are presently coming into increasing use in the copying industry. These and other advantages are achieved by the transfer hold-down detach pump of the present invention which is incorporated into the sheet feeding portion of the system. A detailed disclosure of a sheet feeder can be found in U.S. Application, Ser. No. 446,555 filed on Dec. 3, 1982, in the name of Carl P. Anderson, and assigned to a common assignee with the present invention.

The subject invention includes a vacuum pump to provide a force which holds the copy paper against the transfer roll as it leaves the nip. The paper is held with sufficient force to overcome the electrostatic attraction the photoconductive drum exerts on the copy paper after image transfer has taken place.

In a preferred embodiment, the vacuum pump includes a cylinder attached to the transfer roll but not rotating with it, and a piston which is moved in a reciprocating fashion by a cam and lever mechanism. The cam is specifically designed to have surfaces inclined at varying angles. At one end of the lever rolls over the cam, a first immediate high vacuum is generated to pull the paper's leading edge against the transfer roll; as the cam continues its rotation, the vacuum continues to increase but at a slower rate to hold the paper against the roll as the rest of the paper passes through the transfer nip area. In one embodiment of the present invention, a third segment of the outer surface of the cam is designed as a dwell surface wherein the vacuum is maintained without significant increase or decrease; the final portion of the cam surface provides for release of the vacuum and return of the piston within the cylinder to its starting position, ready for the next cycle which will conicide with receipt of the leading edge of the next sheet of blank paper.

In the system as designed, a manifold is provided communicating with the surface of the drum through a series of holes. The manifold is also connected to a hollow shaft, the end of the shaft passing into the cylinder head and continuously communicating with the vacuum chamber through a groove and hold arrangement. As the vacuum is created in the manifold, the paper is held by ambient air pressure pressing the paper against holes in the surface of the transfer roll. The cam, which operates the piston, has varying inclined surfaces to provide varying different rates of change in the vacuum force as described above. The cam is timed so that its rotation corresponds to the position of the line of vacuum holes in the vacuum roll surface. When the line of holes is about 5/16 of an inch before the transfer nip, and substantially aligned with or slightly behind the leading edge of the blank paper, the cam forces the piston to pull out of the cylinder at a rapid acceleration for a short time. This causes a high vacuum which pulls the paper against the transfer roll. Continued rotation of the cam pulls the piston out at a slower rate, maintaining the vacuum which continues to hold against the transfer roll as the remainder of the paper passes through the transfer nip area. So the paper discharge point is reached; the vacuum on the leading edge is released, and the cam rotates back to its original position, awaiting the start of the next transfer cycle and the arrival of the next blank sheet of paper. By mounting the cam on a shaft rotating synchronously with the transfer drum, consistent alignment between initiation of the vacuum and the blank sheet of paper reaching the holes in the surface of the drum is assured.

These and other advantages are defined above for the present invention will be more fully explained by reference to the attached drawings with respect to which a preferred embodiment will be described. In these drawings, FIG. 1 is a schematic outline of the photoconductive drum and transfer roll, the transfer roll incorporating the vacuum generating system of the present invention;

Figure 1:
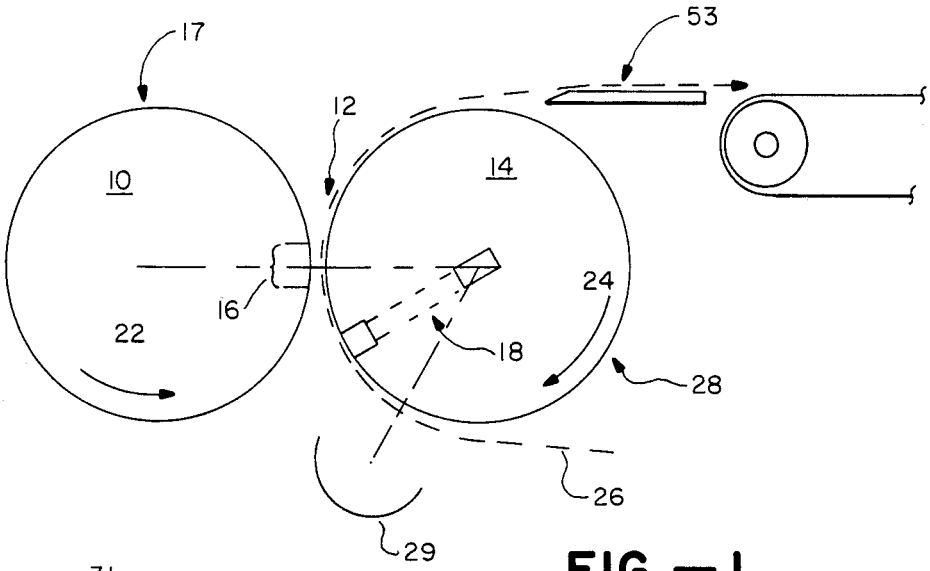

Turning to FIG. 1, this figure illustrates part of an electrophotographic copying apparatus including an electrophotographic drum 10 and a toner transfer station 12 defined by the photoconductive drum 10 and transfer drum 14 which together define the transfer nip 16. The photoconductive drum is rotated in a controlled manner to move its outer photoconductive surface 17 along a fixed annular path through a charging station, an exposure station, developing station, and thereafter the transfer nip 16 of transfer station 12. None of these stations are illustrated except for transfer station 12 which includes the roller 14 and the transfer hold-down detach pump 18 with which this invention is particularly concerned.

In operation, photoconductive drum 14 rotates in the direction of arrow 22 to cause a segment of the drum's outer surface to move through the charging station to charge the drum surface to a desired fixed level of polarity. Thereafter, the charged surface segment is moved through the exposure station where an image of an original or master is projected onto the moving drum to discharge portions of its charged surface and thus form an electrostatic image conforming to the original. The electrostatic image thus formed is then moved through the developing station which contains a suitable arrangement including a supply of heat fusable toner charged to a polarity opposite that of the latent image, for example of negative polarity, and means for applying the toner to the drum's outer surface. Thus, as the image bearing drum surface moves through to the developing station, the charged toner is applied to develop the image, the toner being held to the latent image by electrostatic attraction.

Immediately after the latent image has been developed it is moved through transfer station 12 which includes the previously mentioned transfer roll 14 and transfer hold-down pump 18. The transfer station also includes means (not shown) either supporting the transfer roll for free rotation of rotating it in a positive manner in the direction of arrow 24. A paper supply system (not shown) provides blank paper 26 in separate sheets through a fixed path 27 past a transfer corona 29 which facilitates adhesion of the transfer drum 14 surface. The paper is carried by the transfer drum into the transfer nip where it contacts the photoconductive surface 17. As a result, the toner on the latter is transferred to the blank sheet 26 forming a copy of the original as indicated by the transferred toner. After toner is transferred to the paper 26, the paper moves through a fusing station which fuses the toner onto the paper providing a permanent copy.

Turning specifically to the transfer of toner to the blank paper, the toner takes the form of particles electrostatically charged to a polarity opposite that of the electrostatic image. As the toner is transferred to the paper, an electrostatic attraction is established between the paper and the surface of the photoconductive drum 10 which must be overcome in order to carry the now developed paper 26 around the surface 28 of drum 14 into the fuser station or other paper detach mechanism. It is for this purpose that the vacuum hold-down pump of the present invention is especially provided.

Figure 2B:
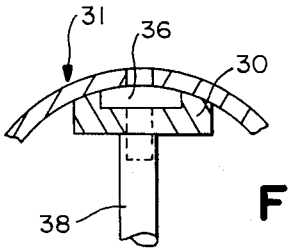
FIG. 2B is a cross-sectional view of a portion of the transfer drum showing the manifold, and the holes in the surface of the drum.
Figure 2A:
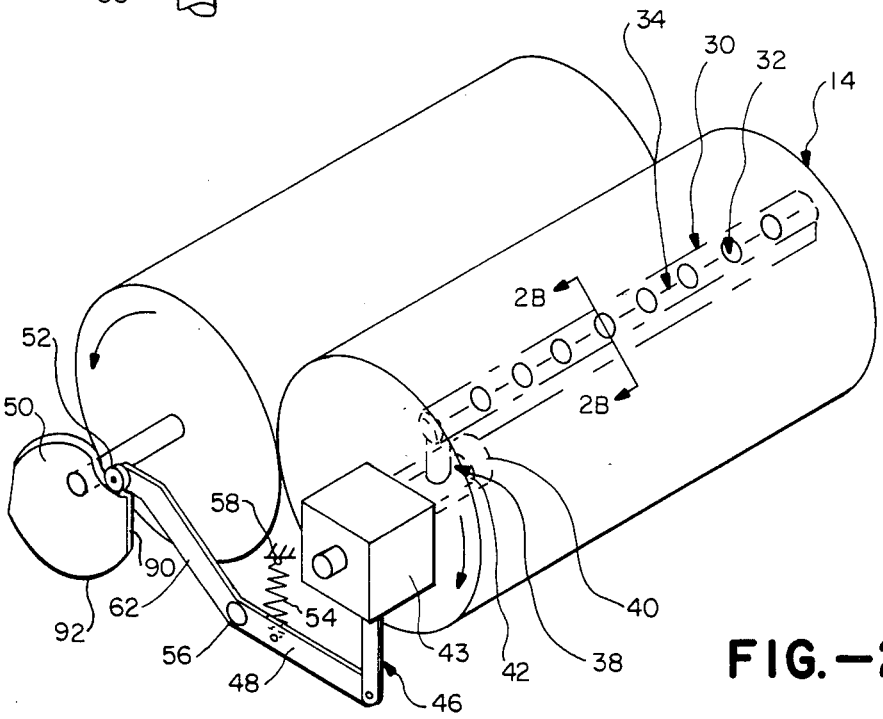
FIG. 2A is a detailed view of the vacuum pump and its connections with the vacuum holes in the surface of the transfer drum.

An outline of the details of the pump appears in FIG. 2A. FIG. 2A.

FIG. 2A shows the transfer drum 14, and the vacuum system 18. The transfer drum includes a vacuum manifold 30 mounted within the upper surface of the rotating surface 28 of the drum and shown in cross-sectional view in FIG. 2B. The manifold 30 communicates with the surface of the drum through a plurality of vacuum holes 32 which are aligned across the surface of the drum perpendicular to the direction of travel of the paper. The relative position of the lead edge of paper which is to pass through the transfer nip to receive the toner and thereby from a copy of the latent image is shown briefly by line 34 as being slightly in advance of the line of holes across the drum to insure that the vacuum will be applied near to but not in front of the leading edge of the paper.

The vacuum manifold itself, as shown in FIG. 2B, is open to the surface 31 through a plurality of holes 32, communicate. A groove 36 in the manifold 30 communicates with the pump through a pipe 38 made of plastic or otherwise which runs to a hollow shaft 40 having a center line hole 42. The shaft 40 runs into the vacuum pump cylinder 44 of vacuum pump 43 which is shown in detail in FIG. 4A and 4B and, being carried by drum 14, rotates with the drum inside the cylinder head of the pump.

Figure 3:
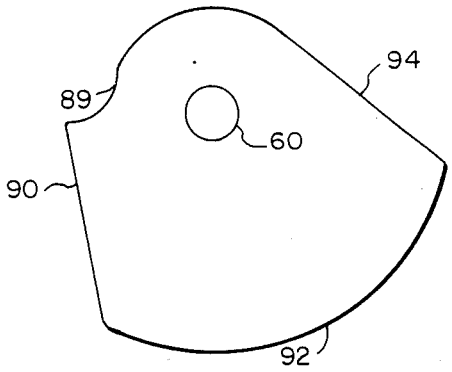
FIG. 3 is an elevational view of the cam which is used to provide the timing of the cycles for the vacuum pump.
Figure 4A:
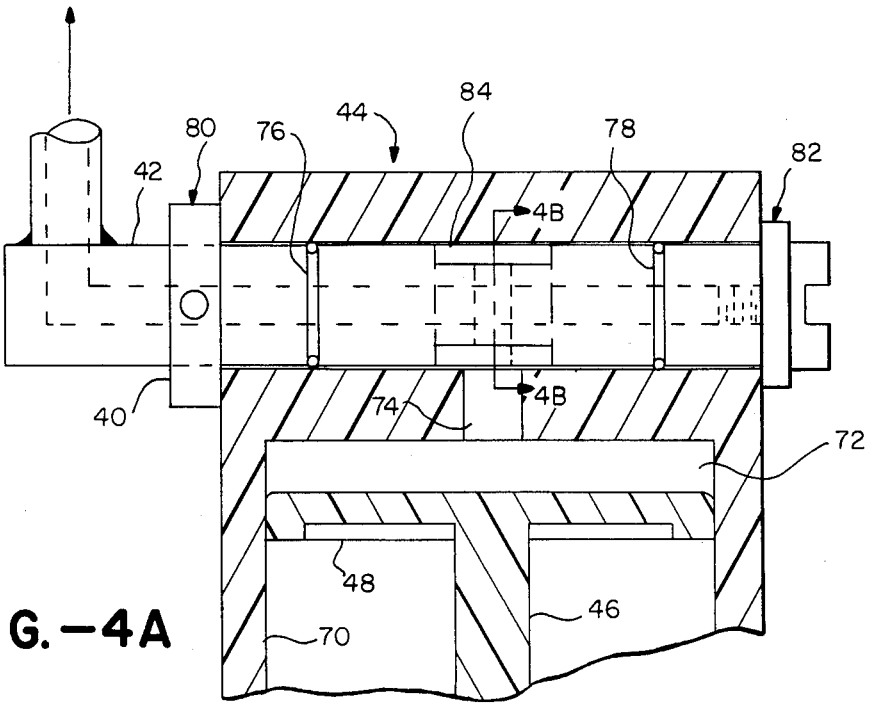
FIG. 4A is a cross-sectional view of the vacuum pump shown in outline form in FIG. 2 including its connections to the vacuum manifold.
Figure 4B:
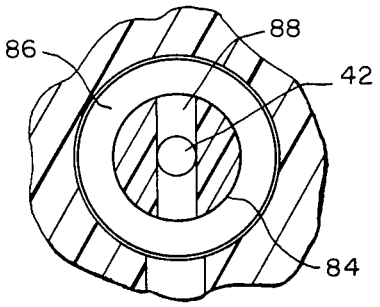
FIG. 4B is a cross-sectional view of the reduced cross-sectional area of the hollow pipe which provides communication between the vacuum chamber and the manifold.

The piston (not shown in FIG. 2A) of the vacuum pump is driven by arm 46 which is connected through an obtuse angle lever arm 48 to a cam 50. The cam rotates on a common shaft with the drum 17 which is geared to drum 14 for synchronous movement. Thus the timing provided by the cam is always consistent with the movement of the line of vacuum holes on the surface of the transfer drum through the transfer nip, and the movement of the latent image through the nip as explained in detail below with reference to FIG. 3. The obtuse angle arm 48 includes a wheel 52 riding across the surface of the cam, and a spring 54 fixed between the point of rotation 56 of the arm and some fixed location 58 in the copying system. The spring 54 thereby always biases the piston shaft 46 inwardly toward the vacuum pump cylinder, so that the normal resting position of the cylinder is closed, whereby no vacuum is established. As the cam 50 begins to rotate, a sharply inclined surface, drawn in almost toward the center of the cam 60 and thereby almost radial over a short distance, causes a sharp lifting of the roller 52 and that end 62 of the obtuse angle arm, thereby driving the piston shaft 46 sharply downward. Referring to FIG. 4A, it can be seen that the force exerted on the shaft 46 causes the piston 48 which is typically made of leather or the like to slide easily on the cylinder surface 70, (which is usually made of Teflon CR or the like) creating a vacuum in vacuum chamber 72. The vacuum is conveyed through opening 74 to the hollow 42 in the shaft 40 and then to the holes 32 in surface 31. The shaft itself rotates with the drum 14; it therefore turns within the cylinder head 44, being free to rotate due to O-rings 76 and 78. These O-rings, together with blocking means 80 and 82 at each end of the cylinder head allow free rotation of the shaft within the stationary head, while maintaining a seal to prevent dissipation of the vacuum.

Within the cylinder head 43, the rotating shaft 40 has a reduced section portion 84, i.e. a portion of reduced cross-sectional area. The hollow portion within the shaft 42 communicates through a hole 88 with a groove 86 defined by this reduced cross-sectional area. Therefore, the center of the hollow shaft is always in communication with the vacuum chamber 72 through this hollow shaft 42, groove 86 and pipe 88. Therefore, the vacuum created in chamber 72 is immediately conveyed through this series of openings and pipe 88 to manifold 30. The vacuum is thereby applied through a series of holes on the surface of the transfer drum to the paper.

After this first sharp portion of the timing cam 50 cycle is ended, the roller 52 moves on to the next portion of the cam, an inclined surface 90 which may be substantially or close to perpendicular to a radius of the cam and defines a second portion of the vacuum cycle. As the roller 52 rolls along the surface, the shaft 46 continues to be slowly withdrawn from the cylinder, carrying with it the cylinder head 48, and gradually continuing the vacuum applied to the surface of the transfer drum. At the end of this second segment, the roller 52 moves on to the third segment 92 of the cam which is substantially circular around a constant radius, and constitutes a dwell portion of the vacuum system.

The vacuum in at the surface of the drum can only be maintained by continuing to slowly withdraw the piston from the cylinder; the vacuum would otherwise naturally dissipate due to the porosity of the paper. The leading edge of the paper remains against the drum due to its own weight as well as the vacuum against the drum to be carried through a fusing station or to a paper discharge station where the paper may be forcibly removed for example by knife edge 53.

Finally, the roller returns to the initial nearly radial portion 89, this is also the resting area between cycles should the machine be stopped for any reason.

As can be seen, the timing cam 50 thereby divides the initiation and depletion of the vacuum into a series of successive cycles; by mounting the cam on a shaft for synchronous rotation with the transfer drum, initiation and release of the vacuum can be carefully timed in conjunction with the movement of the paper through the transfer nip and on around the drum to the next station or for release. Specifically, when the paper reaches the transfer nip 16 it is held by ambient air pressure because of the vacuum being pulled through the manifold 30 by the vacuum pump, resulting in the paper being pressed against the holes 32 in the surface of the roll 14. The cam 50 which operates the piston 48, is timed so that its rotation corresponds to the position of the line of vacuum holes in the transfer surface. When the line of holes 32 is approximately 5/16 of an inch from the transfer nip 16, and the paper has reached the front of the holes in the front surface of the transfer drum, the cam by its surface 89 sharply forces the piston out of the cylinder 43 at a rapid acceleration for a short time. This causes a high vacuum to pull the paper 26 against the surface of the transfer roll, at a time when the electrostatic forces which could draw the paper against this surface of the photoconductive drum are strongly present. Continued rotation of the cam pulls the piston out at the slower rate, generating a vacuum which continues to hold the paper against the transfer roll for the full passage of the paper through the transfer nip area. Finally, the vacuum release and return surfaces 92, 94 are reached; the paper is now carried off the drum and on to the next station to complete copying onto the paper.

Modifications of the system described herein for a multi-step sequence of vacuum creation and depletion may become apparent to one of skill in the art who studies this invention disclosure. Therefore, the subject invention is to be limited only by the scope of the claims appended.

What is claimed:

1. In an electrophotographic copying apparatus in which electrically charged toner of one polarity is transferred from an oppositely electrically charged surface of a photoconductive drum to the front side of a blank sheet for transforming said front side of the blank sheet into an intended copy as the back side of the blank sheet engages the surface of a transfer drum positioned adjacent said photoconductive drum, the transfer of toner occurring within a transfer nip defned by said photoconductive drum and said transfer drum, the improvement comprising a cam rotating in a timed sequence relative to said transfer drum, a vacuum pump located adjacent said transfer drum and actuated by said cam and in communication with the surface of said transfer drum to create a vacuum at said back side of the blank sheet, whereby said paper is held to the surface of said transfer drum by ambient air pressure and said vacuum, overcoming the electrostatic attraction of the blank sheet to said photoconductive drum.

2. The improvement according to claim 1 wherein the surface of said cam comprises (a) a first portion for causing a high initial vacuum;

(b) a second portion for slowly increasing said vacuum; and (c) a third portion for releasing said vacuum, whereby all three segments of an operational cycle to attract and release the blank sheet from the surface of said transfer drum are completed within one rotation of said cam.

3. The improvement according to claim 1 wherein said transfer drum includes a plurality of holes aligned across the surface of said transfer drum substantially perpendicular to the direction of travel of the blank sheet, and means for providing communication between said plurality of holes and a chamber in said vacuum pump defined by a cylinder and a piston reciprocating in said cylinder in response to movement of said cam.

4. The improvement according to claim 3 wherein said cam is mounted on a shaft rotating in synchronism with the surface of said photoconductive drum to insure that said cam rotates in synchronism with the holes on the surface of said transfer drum.

5. The improvement according to claim 2 including an angle arm connected at one end to a piston on said vacuum pump to reciprocate said piston, the other end of said angle arm having a wheel rolling on the surface of said cam to define the portions of the operational cycle of said vacuum pump in creating and releasing a vacuum.

6. The improvement of claim 5 wherein said cam comprises a first nearly radial surface for defining the first portion of said operational cycle, a second inclined surface for defining the second portion of said operational cycle and a third return surface for defining a third portion of said operational cycle.

7. The improvement of claim 1 wherein means for communicating between said vacuum pump and said surface of the transfer drum comprises a vacuum manifold running substantially perpendicular to the direction of travel of the blank sheet and having openings to the surface of said transfer drum, a hollow shaft rotating with said transfer drum and open to a vacuum chamber defined by a cylinder, and a connection between said hollow shaft and said vacuum manifold for conveying the vacuum from said vacuum pump to the surface of said transfer drum.

8. The improvement of claim 7 wherein said hollow shaft comprises a section of a reduced cross sectional area defining a groove in constant communication with said vacuum chamber.

9. In an electrophotographc copying apparatus in which electrically charged toner of one polarity is transferred from an oppositely electrically charged surface of a photoconductive drum to the front side of a blank sheet for transforming said front side of the blank sheet into an intended copy as the back side of the blank sheet engages the surface of a transfer drum positioned adjacent said photoconductive drum, the transfer of toner occurring within a transfer nip defined by the photoconductive drum and said transfer drum, the improvement comprising vacuum means for providing a vacuum to a row of holes aligned in a row across the surface of said transfer drum substantially perpendicular to the direction of travel of the blank sheet to attract the blank sheet to said transfer drum, and timing means for controlling said vacuum means in at least three stages of operation, a first stage providing a sharply increasing vacuum, a second stage providing a slowly increasing vacuum, and a third stage for releasing said vacuum and returning said timing means to its initial position.

10. The improvement of claim 9 wherein said vacuum means for providing a vacuum comprises a pump mounted externally of and stationary relative to said transfer drum.

11. The improvement of claim 9 wherein said timing means comprises a cam mounted for synchronous rotation with said transfer drum and having surfaces of varying slopes to define said stages, said vacuum means comprising a pump mounted in a stationary position relative to said transfer drum, and an angle arm having one end connected to a piston of said pump and the other end having a wheel rolling on the surface of said cam, whereby the position of said wheel and the stages of operation are controlled by the position of said wheel on said cam surface.

12. The improvement of claim 11 including spring means normally biasing said piston into a closed position relative to a cylinder of said pump whereby no vacuum is created.

13. The improvement of claim 12 including a manifold on the transfer drum and open to the surface of the transfer drum through said row of holes, a hollow shaft turning with said transfer drum, a bore in said hollow shaft before connected to said manifold, said hollow shaft extending into the cylinder of said transfer drum wherein said bore communicates with a vacuum chamber of said pump.

14. The improvement of claim 13 wherein said hollow shaft includes a section of a reduced cross sectional area defining a groove in constant communication with said vacuum chamber.

* * * * *